US007097716B2

(12) United States Patent
Barnes et al.

(10) Patent No.: US 7,097,716 B2
(45) Date of Patent: Aug. 29, 2006

(54) METHOD FOR PERFORMING FLUOROCARBON CHAMBER CLEANING TO ELIMINATE FLUORINE MEMORY EFFECT

(75) Inventors: Michael Barnes, San Ramon, CA (US); Huong Thanh Nguyen, San Ramon, CA (US)

(73) Assignee: Applied Materials, Inc., Santa Clara, CA (US)

( * ) Notice: Subject to any disclaimer, the term of this patent is extended or adjusted under 35 U.S.C. 154(b) by 299 days.

(21) Appl. No.: 10/274,093

(22) Filed: Oct. 17, 2002

(65) Prior Publication Data

US 2004/0077511 A1 Apr. 22, 2004

(51) Int. Cl.
*B08B 3/00* (2006.01)

(52) U.S. Cl. ..... 134/26; 134/1.1; 134/22.1; 134/30; 438/905

(58) Field of Classification Search ..... 134/1.1, 134/22.1, 26, 30; 438/905
See application file for complete search history.

(56) References Cited

U.S. PATENT DOCUMENTS

| | | | | | |
|---|---|---|---|---|---|
| 4,820,377 | A | * | 4/1989 | Davis et al. | 134/1.1 |
| 4,842,683 | A | | 6/1989 | Cheng et al. | 156/345 |
| 4,916,091 | A | * | 4/1990 | Freeman et al. | 438/784 |
| 5,158,644 | A | * | 10/1992 | Cheung et al. | 438/694 |
| 5,164,017 | A | * | 11/1992 | Moller et al. | 134/22.18 |
| 5,207,836 | A | | 5/1993 | Chang | 134/1 |
| 5,326,723 | A | * | 7/1994 | Petro et al. | 438/685 |
| 5,417,826 | A | * | 5/1995 | Blalock | 204/176 |
| 5,534,108 | A | | 7/1996 | Qian et al. | 156/643.1 |
| 5,585,012 | A | | 12/1996 | Wu et al. | 216/71 |
| 5,647,953 | A | * | 7/1997 | Williams et al. | 134/1.1 |
| 5,679,215 | A | * | 10/1997 | Barnes et al. | 134/1.1 |
| 5,792,272 | A | * | 8/1998 | van Os et al. | 118/723 R |
| 5,865,896 | A | * | 2/1999 | Nowak et al. | 118/723 I |
| 5,879,575 | A | * | 3/1999 | Tepman et al. | 216/68 |
| 5,980,688 | A | * | 11/1999 | Blalock | 156/345.48 |
| 6,113,731 | A | | 9/2000 | Shan et al. | 156/345 |
| 6,164,295 | A | | 12/2000 | Ui et al. | 134/1.1 |
| 6,274,058 | B1 | | 8/2001 | Rajagopalan et al. | 216/67 |
| 6,313,042 | B1 | | 11/2001 | Cohen et al. | 438/734 |
| 6,569,257 | B1 | * | 5/2003 | Nguyen et al. | 134/26 |
| 2001/0008138 | A1 | | 7/2001 | Demos et al. | 134/1.1 |
| 2002/0052114 | A1 | * | 5/2002 | Marks | 438/689 |

FOREIGN PATENT DOCUMENTS

| | | | |
|---|---|---|---|
| EP | 0 418 592 A1 | | 3/1991 |
| EP | 418592 | * | 3/1991 |

OTHER PUBLICATIONS

"The Chamber Memory Effect Induces P+ Junction Leakage and EEPROM Tunneling Oxide Degradation", C.D. Chang, et al., IEEE/CPMT International Electronics Manufacturing technology Symposium, 1999, pp. 348-352.
"Study of Chamber History Effect in Oxide Etcher", C.H. Liao, et al., Taiwan Semiconductor manufacturing Company Ltd., 5th International Symposium on Plasma Process-Induced Damage, May 23-24, 2000 Santa Clara, CA., pp. 85-88.
U.S. Appl. No. 09/710,357, filed Nov. 9, 2000, US 6569257.

* cited by examiner

*Primary Examiner*—Charles Boyer
(74) *Attorney, Agent, or Firm*—Patterson & Sheridan LLP

(57) ABSTRACT

A method of cleaning a plasma etching reactor is provided. The method of cleaning a plasma etching reactor includes generating one or more plasmas from oxygen gas and a hydrogen-containing gas, and exposing interior surfaces of the reactor to the plasma(s) from the oxygen-gas and the hydrogen-containing gas. The cleaning method is used to remove deposited material, such as deposits containing fluorine, carbon, oxygen, and hydrogen from interior surfaces of the reactor. The hydrogen-containing gas may contribute to the cleaning method by providing a source of hydrogen that removes fluorine from the surfaces of the reactor.

15 Claims, 4 Drawing Sheets

METHOD FOR PERFORMING FLUOROCARBON CHAMBER CLEANING TO ELIMINATE FLUORINE MEMORY EFFECT

BACKGROUND OF THE INVENTION

1. Field of the Invention

Embodiments of the present invention generally relate to methods of cleaning etching reactors.

2. Description of the Related Art

Multiple layers of conducting, semiconducting, and dielectric materials are typically deposited and removed from a substrate during the fabrication of integrated circuits. Known etching techniques, such as wet etching and dry etching, e.g., plasma etching, can be used to remove material from a substrate. Examples of materials that may be removed from a substrate during an etching process include silicon oxides, such as silicon dioxide ($SiO_2$), $SiCH_3$, and other dielectric materials, such as low dielectric constant (low k) materials, e.g., carbon-doped oxides, polyimides, polytetrafluroethylenes, parylenes, polysilsesquioxanes, fluorinated poly(aryl ethers), and fluorinated amorphous carbon.

Etching processes are typically performed in etching reactors. A conventional plasma etching reactor includes a reactor chamber and an apparatus for producing a plasma within the reactor chamber. Etching processes typically include the use of a plasma of fluorine-containing gases, such as $CHF_3$, $CF_4$, $C_4F_6$, $C_4F_8$, and $CH_2F_2$ to remove material from a substrate. While fluorine is an effective etchant, fluorine can also etch and damage the surfaces of the plasma etching reactor chamber during etching processes. When fluorine attacks the surfaces of the chamber, it can react with components of the chamber surfaces to form contaminants on the chamber surfaces. For example, fluorine can react with an $Al_2O_3$ chamber surface and form contaminating $AlF_x$ particles, such as $AlF_3$. Other contaminants that may form on the chamber surface include $C_xF_y$ and residues that contain fluorine, carbon, oxygen, and/or hydrogen and are referred to as fluorocarbon polymers. Over time, the contaminants may dislodge from the chamber surfaces, land on a substrate in the chamber, and contaminate the substrate. Even if the contaminants do not directly impact a substrate, the presence of the contaminants on the chamber surfaces can affect the etching processing environment. Generally, it is believed that the plasma processing conditions within an etching reactor are a result of current processing conditions and prior processes that may leave a "memory effect" or a "chamber history effect," such as the contaminants described herein. For example, fluorine from fluorine-containing contaminants that were embedded in the chamber surface during a previous etching process may leach out of the chamber surface during a subsequent fluorine-based etching process. The fluorine leached from the chamber surface increases the effective concentration of fluorine during the etching process, which may increase, or otherwise change, the etching rate. The changes to the etching process from substrate to substrate due to a memory effect degrade the etching process uniformity and reliability. Uncontrolled changes in etching can lead to changes in device geometries and dimensions of semiconductor substrates.

Methods of cleaning etching reactors to remove contaminants generated during etching have been developed. Methods of cleaning an etching reactor include physically, i.e., manually, cleaning the reactor, wet cleaning, and using a plasma from a fluorine-containing gas or from a fluorine-containing gas and oxygen gas to clean the reactor. Physically cleaning a reactor typically requires reactor downtime, which lowers substrate throughput. Wet cleaning processes can be used, but they are typically time consuming and cannot be performed after only one or several substrates are etched. Furthermore, wet cleaning processes are not effective in removing all of the fluorine that remains in the chamber after etching. A plasma from a fluorine-containing gas or from a fluorine-containing gas and oxygen gas is typically effective in removing some contaminants from a reactor. However, a plasma from a fluorine-containing gas or from a fluorine-containing gas and oxygen gas generally does not remove the desired amount of fluorine and other contaminants from the reactor. Therefore, there remains a need for methods of effectively cleaning plasma etching reactors.

SUMMARY OF THE INVENTION

A method of cleaning a plasma etching reactor is provided. In one embodiment, a method of cleaning a plasma etching reactor includes generating one or more plasmas from oxygen gas and a hydrogen-containing gas and exposing one or more interior surfaces of the reactor to the one or more plasmas to remove material deposited on the interior surfaces of the reactor. The plasma(s) may be generated within the reactor or within a remote plasma source connected to the reactor.

In one embodiment, the oxygen gas and the hydrogen-containing gas are present in the reactor at the same time, and the reactor is exposed to a plasma from the oxygen gas and the hydrogen-containing gas in a one step cleaning method.

In other embodiments, the oxygen gas and the hydrogen-containing gas are used in a two step cleaning method. In one embodiment, a plasma from oxygen gas is used in one step, and a plasma from oxygen gas and a hydrogen-containing gas is used in another step. In another embodiment, a plasma from oxygen gas is used in one step, and a plasma from a hydrogen-containing gas and $H_2O$ gas is used in another step.

BRIEF DESCRIPTION OF THE DRAWINGS

So that the manner in which the above recited aspects of the present invention are attained and can be understood in detail, a more particular description of embodiments of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION

Embodiments of the invention provide a method of cleaning plasma etching reactors. A plasma etching reactor may be cleaned in situ after one or more etching processes have been performed in the plasma etching reactor. The etching process can be used for example, to create apertures, such as vias and trenches in a substrate or in layers formed on a substrate. The reference to substrate may be used herein to include the substrate or layers formed on the substrate.

Embodiments of methods of cleaning plasma etching reactors will be described with respect to an eMAX™ reactor shown in FIG. 1. The methods of cleaning plasma etch reactors described herein can also be performed in plasma etch reactors such as other eMAX™ reactors, IPS™ reactors, DPS™ reactors, and ASP reactors, all of which are available from Applied Materials, Inc., of Santa Clara, Calif. Examples of plasma etch reactors are described in U.S. Pat. No. 6,113,731, issued Sep. 5, 2000 and entititled "Magnetically-Enhanced Plasma Chamber with Non-Uniform Magnetic Field," U.S. Pat. No. 5,534,108, issued Jul. 9, 1996 and entitled "Method and Apparatus for Altering Magnetic Coil Current to Produce Etch Uniformity in a Magnetic Field-Enhanced Plasma Reactor," and U.S. Pat. No. 4,842,683, issued Jun. 27, 1989 and entitled "Magnetic Field-Enhanced Plasma Etch Reactor," all of which are incorporated by reference herein.

Figure 1:
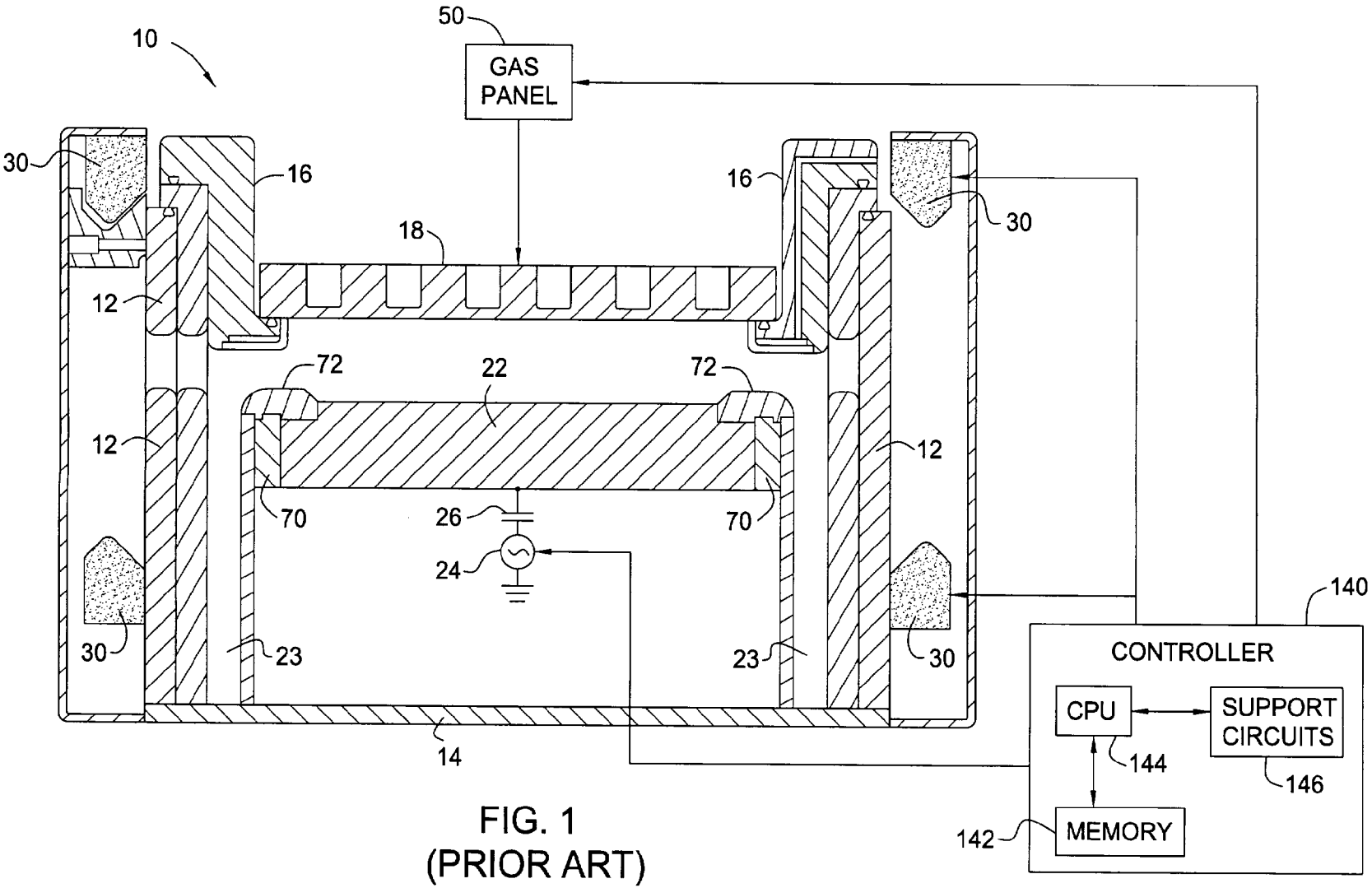
FIG. 1 (PRIOR ART)
FIG. 1 depicts a schematic diagram of a plasma etching reactor of the kind used in performing a cleaning process according to one embodiment of the present invention.

FIG. 1 shows a magnetically-enhanced eMAX™ reactor 10 suitable for etching processes. The eMAX™ reactor 10 will be described briefly with respect to FIG. 1. The eMAX™ reactor 10 of FIG. 1 is further described in U.S. Pat. No. 6,113,731.

The vacuum chamber of reactor 10 is enclosed by cylindrical side wall 12, circular bottom wall 14, and circular top wall or lid 16. The lid 16 and bottom wall 14 may be either dielectric or metal. An electrically grounded anode electrode 18 is mounted at the bottom of the lid 16. The anode electrode may be perforated to function as a gas inlet through which process gases from the gas panel 50 enter the reactor. The side wall 12 may be either dielectric or metal. If it is metal, the metal must be a non-magnetic material such as anodized aluminum so as to not interfere with the magnetic field created by electromagnet coils outside the reactor. If the side wall is metal, it will function as part of the anode.

The cathode electrode 22 is mounted in the lower end of the reactor. A cylindrical dielectric shield 70 surrounds the sides of the cylindrical cathode electrode 22, and a dielectric ring 72 covers the portion of the cathode top surface which surrounds a wafer (not shown). A vacuum pump, not shown, exhausts gases from the reactor through exhaust manifold 23 and maintains the total gas pressure in the reactor at a level low enough to facilitate creation of a plasma, typically in the range of 10 millitorr to 20 torr.

An RF power supply 24 is connected to the cathode electrode 22 through a series coupling capacitor 26. The RF power supply provides an RF voltage between the cathode electrode and the grounded anode electrode 18 which excites the gases within the reactor into a plasma state. The plasma body has a time-average positive DC potential or voltage relative to the cathode or anode electrodes which accelerates ionized process gas constituents to bombard the cathode and anode electrodes.

Magnetic enhancement of the plasma most commonly is implemented by a DC magnetic field in the region between the cathode and anode electrodes. The direction of the magnetic field is transverse to the longitudinal axis of the reactor, i.e., transverse to the axis extending between the cathode and anode electrodes. Various arrangements of permanent magnets or electromagnets are conventionally used to provide such a transverse magnetic field. One such arrangement is the pair of coils 30 shown in FIG. 1, disposed on opposite sides of the cylindrical reactor side wall 12. The two coils 30 are connected in series and in phase to a DC power supply, not shown, so that they produce transverse magnetic fields which are additive in the region between the two coils.

A controller 140 comprising a central processing unit (CPU) 144, a memory 142, and support circuits 146 is coupled to various components of the reactor 10, such as the coils 20, the RF power supply 24, and the gas panel 50, to facilitate control of the reactor cleaning process of the present invention. To facilitate control of the reactor as described above, the CPU 144 may be one of any form of general purpose computer processor that can be used in an industrial setting for controlling various reactors and sub-processors. The memory 142 is coupled to the CPU 144. The memory 142, or computer-readable medium, may be one or more of readily available memory such as random access memory (RAM), read only memory (ROM), floppy disk, hard disk, or any other form of digital storage, local or remote. The support circuits 146 are coupled to the CPU 144 for supporting the processor in a conventional manner. These circuits include cache, power supplies, clock circuits, input/output circuitry and subsystems, and the like. The inventive method (described with respect to FIGS. 2–6) is generally stored in the memory 142 as software routine. The software routine may also be stored and/or executed by a second CPU (not shown) that is remotely located from the hardware being controlled by the CPU 144.

In one embodiment, a method of cleaning a plasma etching reactor includes generating one or more plasmas from oxygen gas and a hydrogen-containing gas and exposing one or more interior surfaces of the reactor to the one or more plasmas to remove material deposited on the interior surfaces of the reactor. The hydrogen-containing gas may be selected from the group consisting of hydrogen ($H_2$), water vapor ($H_2O$ gas), hydrogen peroxide ($H_2O_2$), ammonia ($NH_3$), fluoromethane ($CH_3F$), and combinations thereof. For example, the hydrogen-containing gas may be $H_2$. The oxygen gas and the hydrogen-containing gas may be introduced into the reactor simultaneously, or at approximately the same time. This embodiment may be considered a one step cleaning process since the reactor is exposed to a plasma of the oxygen gas and the hydrogen-containing gas in one step. This embodiment is described below with respect to FIG. 2.

In any of the embodiments described herein, a plasma of activated gases in the reactor reacts with material deposited, i.e., residual deposits, on the interior surfaces of the reactor to form compounds, such as volatile compounds, that can be removed from the reactor, thus cleaning the interior surfaces of the reactor. Embodiments of the cleaning methods may be performed after one or more substrates have been processed, e.g., etched, in the plasma etching reactor. The time required to clean the reactor varies, according to factors such as the size of the reactor and the amount of residual deposits on the interior surfaces of the reactor. Generally, the reactor is cleaned after etching one or more substrates for an amount of time that is about 10% of the amount of time that the reactor has been used to etch the one or more substrates. For example, if a previously unused reactor or a reactor that has just been cleaned is used to etch one or more substrates for about 3 minutes per substrate, the reactor may be cleaned using a plasma of the gases described herein for about 18 to about 20 seconds per substrate.

The temperature of the reactor during cleaning is typically about the same as the temperature of the reactor during the etching process performed prior to the reactor cleaning. Thus, additional time is typically not required to change the temperature of the reactor after processing and before cleaning. In one example, the walls of the reactor may be between about 50° C. and about 70° C., while the substrate support may be between about −20° C. and about 20° C. during the reactor cleaning process. An elevated temperature, such as between about 50° C. and about 70° C., of the walls of the reactor is preferable, as elevated temperatures promote the cleaning process. Furthermore, the reactor walls typically have more deposited material to be removed than the substrate support, as the substrate support is generally shielded by a substrate from deposits during processing.

Figure 2:
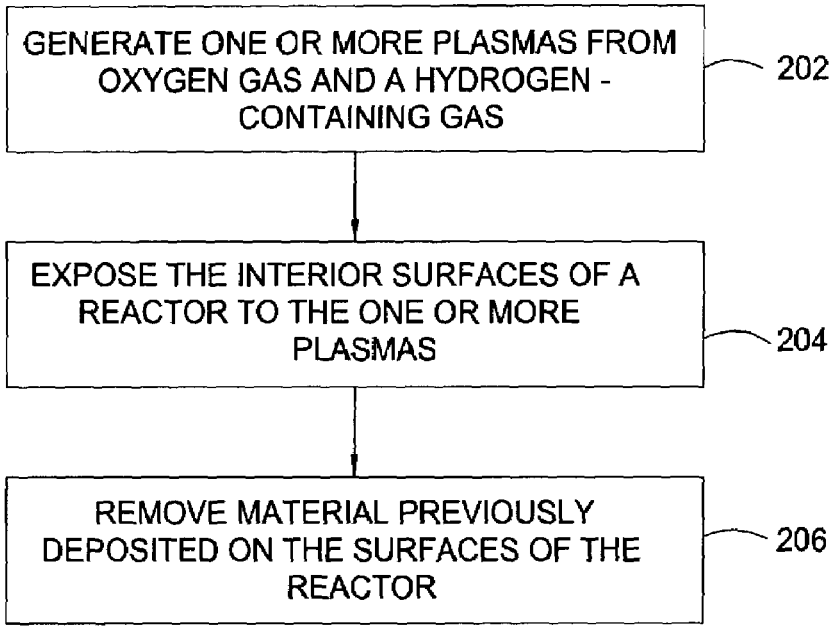
FIG. 2 depicts a flow diagram of an exemplary embodiment of the present invention.

FIG. 2 is a flow diagram that represents one embodiment. One or more plasmas from oxygen gas and a hydrogen-containing gas are generated in step 202. The interior surfaces of the reactor are exposed to the one or more plasmas in step 204. Material previously deposited on the interior surfaces of the reactor is removed in step 206. The oxygen gas may be introduced into the reactor at about 100 sccm to about 2000 sccm, and the hydrogen-containing gas may be introduced into the reactor at about 10% to about 20% by volume of a total flow of gases into the reactor. For example, the oxygen gas may be introduced into the reactor at about 80% to about 90% by volume of the combined flow of the oxygen gas and the hydrogen-containing gas, and the hydrogen-containing gas may be introduced into the reactor at about 10% to about 20% by volume of the combined flow.

Figure 3:
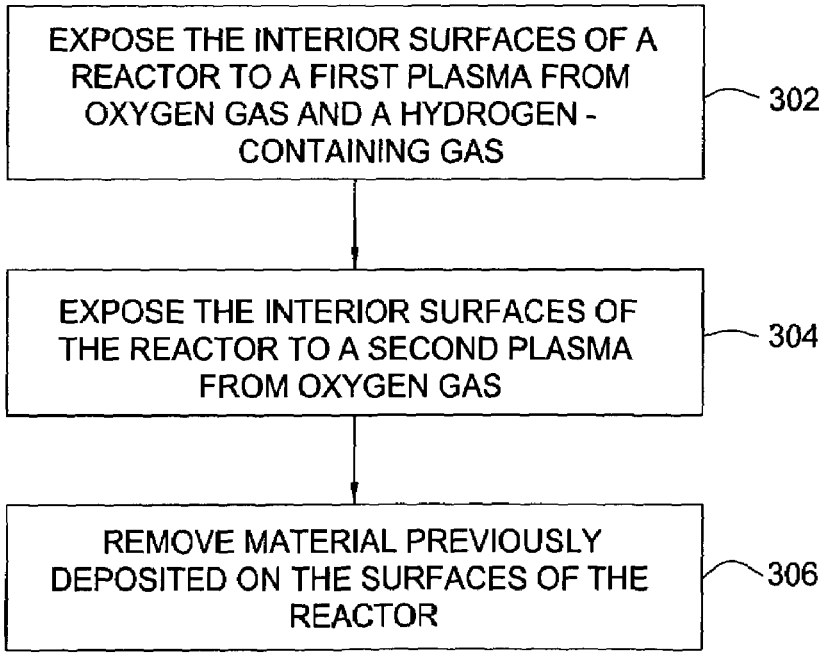
FIG. 3 depicts a flow diagram of an exemplary embodiment of the present invention.

In another embodiment, a two step cleaning method is provided. In the first step, one or more interior surfaces of the reactor are exposed to a first plasma from oxygen gas and a hydrogen-containing gas in a first step and exposed to a second plasma from the oxygen gas in a second step. FIG. 3 is a flow diagram that represents this embodiment. The interior surfaces of the reactor are exposed to a first plasma from oxygen gas and a hydrogen-containing gas in step 302. The interior surfaces of the reactor are exposed to a second plasma from oxygen gas in step 304. Material previously deposited on the interior surfaces of the reactor is removed in step 306. The hydrogen-containing gas may be selected from the group consisting of $H_2$, $H_2O$ gas, $H_2O_2$, $NH_3$, $CH_3F$, and combinations thereof. For example, the hydrogen-containing gas may be $H_2$. Optionally, a small amount, such as less than about 200 sccm, of fluorine-containing gas, such as $CF_4$, is introduced with the oxygen gas in the second step. In the first step, the oxygen gas may be introduced into the reactor at about 100 sccm to about 2000 sccm, and the hydrogen-containing gas may be introduced into the reactor at about 10% to about 20% by volume of a total flow of gases into the reactor. For example, the oxygen gas may be introduced into the reactor at about 80% to about 90% by volume of the combined flow of the oxygen gas and the hydrogen-containing gas, and the hydrogen-containing gas may be introduced into the reactor at about 10% to about 20% by volume of the combined flow. In the second step, the oxygen gas may be introduced into the reactor at about 100 sccm to about 2000 sccm.

Figure 4:
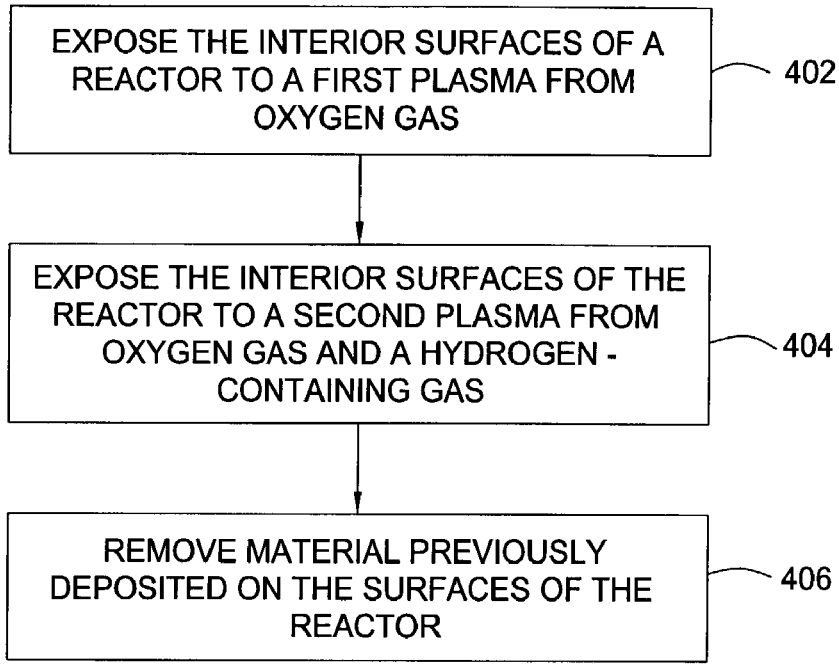
FIG. 4 depicts a flow diagram of an exemplary embodiment of the present invention.

In another embodiment of a two step cleaning method, one or more interior surfaces of the reactor are exposed to a first plasma from oxygen gas in a first step and exposed to a second plasma from oxygen gas and a hydrogen-containing gas in a second step. FIG. 4 is a flow diagram that represents this embodiment. The interior surfaces of the reactor are exposed to a first plasma from oxygen gas in step 402. The interior surfaces of the reactor are exposed to a second plasma from oxygen gas and a hydrogen-containing gas in step 404. Material previously deposited on the interior surfaces of the reactor is removed in step 406. The hydrogen-containing gas may be selected from the group consisting of $H_2$, $H_2O$ gas, $H_2O_2$, $NH_3$, $CH_3F$, and combinations thereof. For example, the hydrogen-containing gas may be $H_2$. Optionally, a small amount, such as less than about 200 sccm, of fluorine-containing gas, such as $CF_4$, is introduced with the oxygen gas in the first step. In the first step, the oxygen gas may be introduced into the reactor at about 100 sccm to about 2000 sccm. In the second step, the oxygen gas may be introduced into the reactor at about 100 sccm to about 2000 sccm, and the hydrogen-containing gas may be introduced into the reactor at about 10% to about 20% by volume of a total flow of gases into the reactor. For example, the oxygen gas may be introduced into the reactor at about 80% to about 90% by volume of the combined flow of the oxygen gas and the hydrogen-containing gas, and the hydrogen-containing gas may be introduced into the reactor at about 10% to about 20% by volume of the combined flow.

Figure 5:
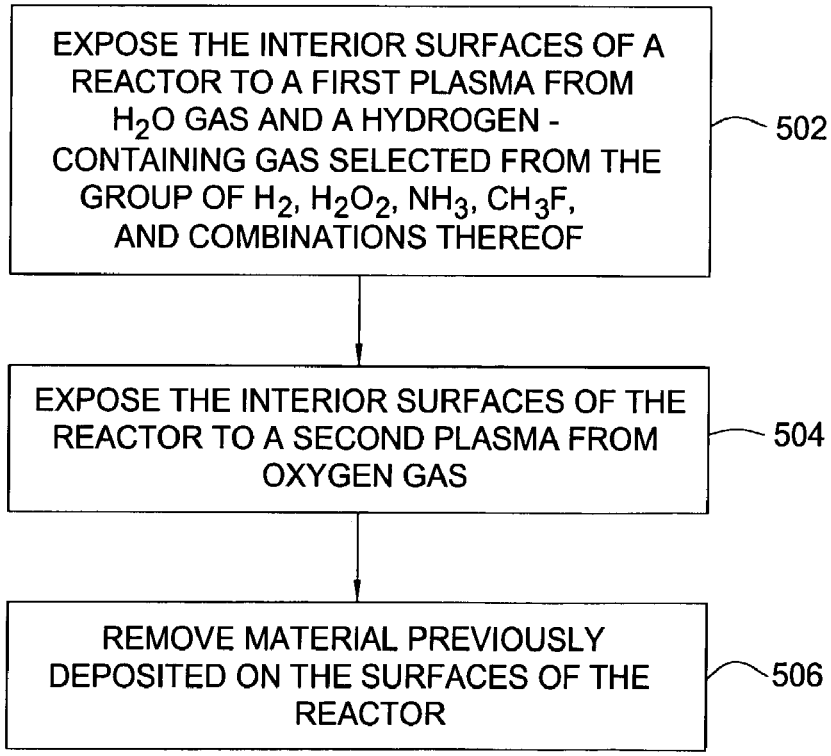
FIG. 5 depicts a flow diagram of an exemplary embodiment of the present invention.

While the embodiments described above include the use of a plasma from both oxygen gas and a hydrogen-containing gas in one step or in one of two steps, in other embodiments, the oxygen gas and the hydrogen-containing gas may be used in plasmas of different steps of a two step cleaning process. For example, in one embodiment, one or more interior surfaces of the reactor are exposed to a first plasma from a hydrogen-containing gas selected from the group consisting of $H_2$, $H_2O_2$, $NH_3$, $CH_3F$, and combinations thereof, and $H_2O$ gas in a first step and exposed to a second plasma from oxygen gas in a second step. For example, the hydrogen-containing gas may be $H_2$. FIG. 5 is a flow diagram that represents this embodiment. The interior surfaces of the reactor are exposed to a first plasma from $H_2O$ gas and a hydrogen-containing gas selected from the group consisting of $H_2$, $H_2O_2$, $NH_3$, $CH_3F$, and combinations thereof in step 502. The interior surfaces of the reactor are exposed to a second plasma from oxygen gas in step 504. Material previously deposited on the interior surfaces of the reactor is removed in step 506. The hydrogen-containing gas may be introduced into the reactor at about 500 sccm to about 3000 sccm. When a dual source reactive ion etch reactor, such as an IPS™ chamber, or a reactor that uses a remote plasma source, such as an ASP chamber, is used, the $H_2O$ gas may be introduced into the reactor at about 50 sccm to about 1000 sccm. When a single source reactor that has a power source connected to the support pedestal, such as an eMAX™ chamber, is used, the $H_2O$ gas may be introduced into the reactor at about 100 sccm to about 1000 sccm. The oxygen gas may be introduced into any of the reactors at about 100 sccm to about 2000 sccm in the second step.

Figure 6:
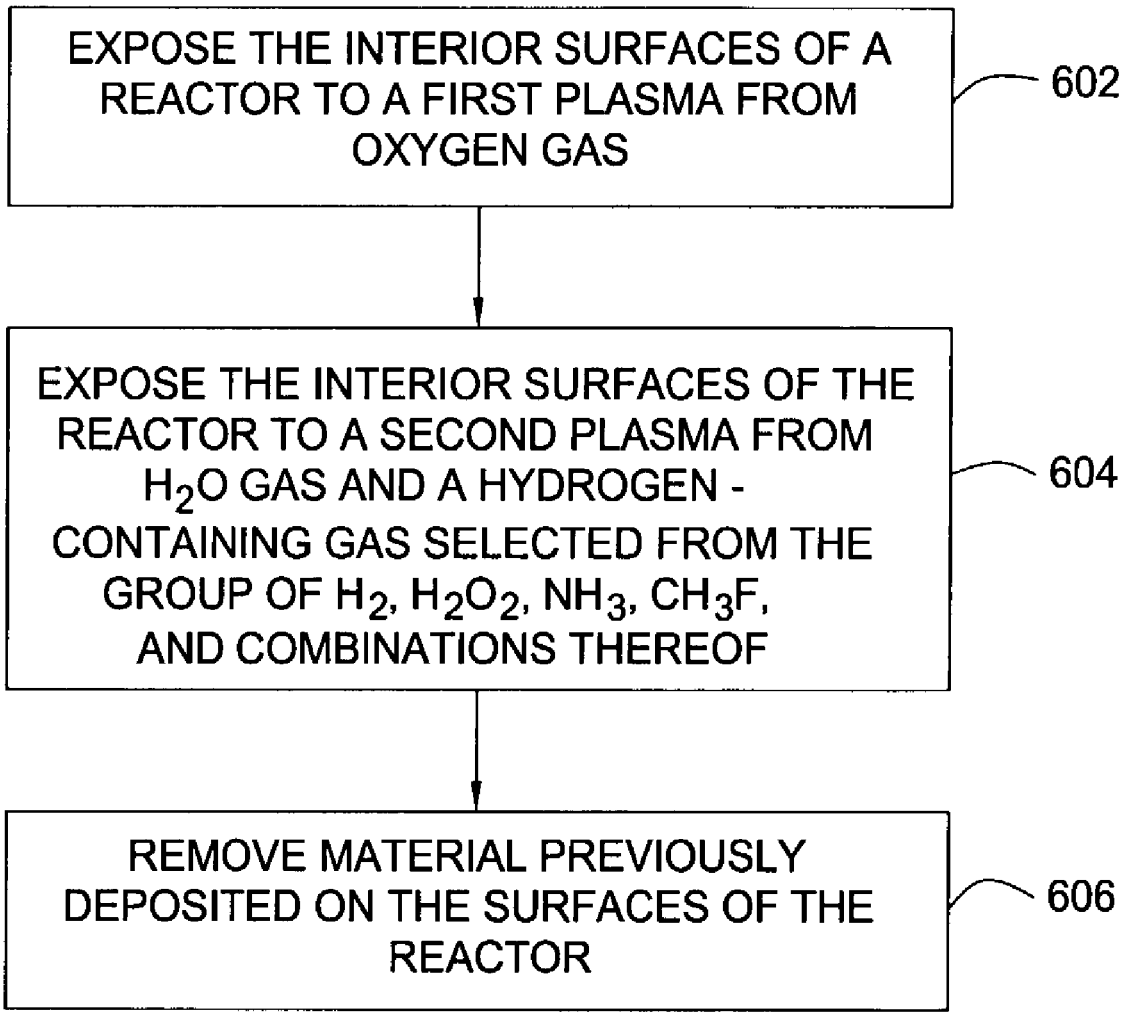
FIG. 6 depicts a flow diagram of an exemplary embodiment of the present invention.

In another embodiment, one or more interior surfaces of the reactor are exposed to a first plasma from oxygen gas in a first step and exposed to a second plasma from a hydrogen-containing gas selected from the group consisting of $H_2$, $H_2O_2$, $NH_3$, $CH_3F$, and combinations thereof, and $H_2O$ gas in a second step. For example, the hydrogen-containing gas may be $H_2$. FIG. 6 is a flow diagram that represents this embodiment. The interior surfaces of the reactor are exposed to a first plasma from oxygen gas in step 602. The interior surfaces of the reactor are exposed to a second plasma from $H_2O$ gas and a hydrogen-containing gas selected from the group consisting of $H_2$, $H_2O_2$, $NH_3$, $CH_3F$, and combinations thereof in step 604. Material previously deposited on the interior surfaces of the reactor is removed in step 606. The oxygen gas may be introduced into the reactors at about 100 sccm to about 2000 sccm in the first step. The hydrogen-containing gas may be introduced into the reactor at about 500 sccm to about 3000 sccm in the second step. When a dual source reactive ion etch reactor, such as an IPS™ chamber, or a reactor that uses a remote plasma source, such as an ASP chamber, is used, the $H_2O$ gas may be introduced into the reactor at about 50 sccm to about 1000 sccm in the second step. When a single source reactor that has a power source connected to the support pedestal, such as an eMAX™ chamber, is used, the $H_2O$ gas may be introduced into the reactor at about 100 sccm to about 1000 sccm in the second step.

Any of the embodiments described herein may be performed in one of several different types of reactors. For example, a dual source reactive ion etch chamber, such as an IPS™ chamber, may be used to inductively couple a radio frequency (RF) power of about 200 watts to about 2000 watts during the cleaning processes. During reactor cleaning, the RF power is delivered via the support pedestal and the coils adjacent the walls of the chamber, and the chamber walls are grounded. The radio frequency may be about 13.56 mHz. The pressure within the reactor may be about 20 millitorr to about 200 millitorr. A single source reactor, such as an eMAX™ chamber, may be used to deliver a RF power of about 200 watts to about 500 watts during the cleaning processes. The radio frequency may be about 13.56 MHz. The pressure within the reactor may be about 100 millitorr to about 800 millitorr. A reactor that uses a remote plasma source, such as an ASP chamber, may be used to deliver a power of about 200 watts to about 2000 watts. The remote plasma source may use microwave power. The pressure in the reactor may be about 500 millitorr to about 5 torr.

In any of the embodiments described herein, a processed substrate, e.g., a substrate that has been etched in the plasma etching reactor, may be present in the plasma etching reactor during the cleaning of a reactor. A photoresist present on the processed substrate may be removed by the process of cleaning of the plasma etching reactor.

In any of the embodiments described herein, it is believed that the activated oxygen of the plasma contributes to the cleaning process by removing components such as carbon from contaminants, e.g., residual deposits, such as fluorocarbon polymers, from the reactor surfaces, such as by chemically reacting with the carbon to form carbon dioxide that can be removed from the reactor. It is believed that the activated hydrogen-containing gas of the plasma contributes to the cleaning process by removing components such as fluorine, which may not be sufficiently removed from the surfaces of the reactor by the activated oxygen of the plasma. It is believed that hydrogen from the hydrogen-containing gas chemically reacts with fluorine in the residual deposits on the reactor surfaces to form HF that can be removed from the reactor.

While the foregoing is directed to embodiments of the present invention, other and further embodiments of the invention may be devised without departing from the basic scope thereof, and the scope thereof is determined by the claims that follow.

What is claimed is:

1. A method of cleaning a plasma etching reactor, comprising:

generating a first plasma from both oxygen gas and a hydrogen-containing gas;

exposing one or more interior surfaces of the reactor to the first plasma to remove material deposited on the interior surfaces of the reactor.

generating a second plasma from the oxygen gas; and exposing the one or more interior surfaces of the reactor to the second plasma to remove material deposited on the interior surfaces of the reactor.

2. The method of claim 1, wherein the hydrogen-containing gas is selected from the group consisting of $H_2$, $H_2O$, $H_2O_2$, $NH_3$, $CH_3F$, and combinations thereof.

3. The method of claim 1, wherein the one or more plasmas are generated within the plasma etching reactor.

4. The method of claim 1, wherein the one or more plasmas are generated within a remote plasma source connected to the plasma etching reactor.

5. The method of claim 1, wherein the oxygen gas of the first plasma is introduced into the reactor at about 100 sccm to about 2000 sccm, the oxygen gas of the second plasma is introduced into the reactor at about 100 sccm to about 2000 sccm, and the hydrogen-containing gas is introduced into the reactor at about 10% to about 20% by volume of a combined flow of the oxygen gas of the first plasma and the hydrogen-containing gas into the reactor.

6. The method of claim 5, wherein the hydrogen-containing gas is $H_2$.

7. A method of cleaning a plasma etching reactor, comprising:

generating a first plasma from both a hydrogen-containing gas and $H_2O$ gas wherein the hydrogen-containing gas is selected from the group consisting of $H_2$, $H_2O_2$, $NH_3$, $CH_3F$, and combinations thereof;

exposing one or more interior surfaces of the reactor to the first plasma to remove material deposited on the interior surfaces of the reactor;

generating a second plasma from oxygen gas; and exposing the one or more interior surfaces of the reactor to the second plasma to remove material deposited on the interior surfaces of the reactor.

8. The method of claim 7, wherein the hydrogen-containing gas is introduced into the reactor at about 500 sccm to about 3000 sccm, the $H_2O$ gas is introduced into the reactor at about 50 sccm to about 1000 sccm, and the oxygen gas is introduced into the reactor at about 100 sccm to about 2000 sccm.

9. The method of claim 8, wherein the hydrogen-containing gas is $H_2$.

10. A method of cleaning a plasma etching reactor, comprising:

generating a first plasma from oxygen gas;

exposing one or more interior surfaces of the reactor to the second plasma to remove material deposited on the interior surfaces of the reactor;

generating a second plasma from both hydrogen-containing gas and $H_2O$ gas, wherein the hydrogen-containing gas is selected from the group consisting of $H_2$, $H_2O_2$, $NH_3$, $CH_3F$, and combinations thereof; and exposing the one or more interior surfaces of the reactor to the second plasma to remove material deposited on the interior surfaces of the reactor.

11. The method of claim 10, wherein the oxygen gas is introduced into the reactor at about 100 sccm to about 2000 sccm, the hydrogen-containing gas is introduced into the reactor at about 500 sccm to about 3000 sccm, and the $H_2O$ gas is introduced into the reactor at about 50 sccm to about 1000 sccm.

12. The method of claim 11, wherein the hydrogen-containing gas is $H_2$.

13. A method of cleaning a plasma etching reactor, comprising:

exposing one or more interior surfaces of the reactor to a first plasma from both oxygen gas and a hydrogen-containing gas;

exposing the one or more interior surfaces of the reactor to a second plasma from oxygen gas; and removing material deposited on the interior surfaces of the reactor.

14. A method of cleaning a plasma etching reactor, comprising:

exposing one or more interior surfaces of the reactor to a first plasma from both $H_2O$ gas and a hydrogen-containing gas selected from the group consisting of $H_2$, $H_2O_2$, $NH_3$, $CH_3F$, and combinations thereof;

exposing the one or more interior surfaces of the reactor to a second plasma from oxygen gas; and removing material deposited on the interior surfaces of the reactor.

15. A method of cleaning a plasma etching reactor, comprising:

exposing one or more interior surfaces of the reactor to a first plasma from oxygen gas;

exposing the one or more interior surfaces of the reactor to a second plasma from $H_2O$ gas and a hydrogen-containing gas selected from the group consisting of $H_2$, $H_2O_2$, $NH_3$, $CH_3F$, and combinations thereof; and removing material deposited on the interior surfaces of the reactor.

* * * * *

UNITED STATES PATENT AND TRADEMARK OFFICE

CERTIFICATE OF CORRECTION

PATENT NO. : 7,097,716 B2
APPLICATION NO. : 10/274093
DATED : August 29, 2006
INVENTOR(S) : Barnes et al.

It is certified that error appears in the above-identified patent and that said Letters Patent is hereby corrected as shown below:

Column 3, Line 22: Change “entititled” to --entitled--

Column 7, Line 27: Change “mHz” to --MHz--

Column 8, Claim 10, Line 53: Change “second” to --first--

Column 8, Claim 10, Line 55; After “both”, insert --a--

Column 10, Claim 15, Line 10: After “from”, insert --both--

Signed and Sealed this

Twenty-third Day of January, 2007

JON W. DUDAS
*Director of the United States Patent and Trademark Office*